US011217947B2

(12) United States Patent
Zhou

(10) Patent No.: US 11,217,947 B2
(45) Date of Patent: Jan. 4, 2022

(54) INTELLIGENT POWER CONNECTING METHOD AND INTELLIGENT CONNECTOR

(71) Applicant: ARGANGLE TECHNOLOGY CO. LTD, Sichuan (CN)

(72) Inventor: Gang Zhou, Sichuan (CN)

(73) Assignee: ARGANGLE TECHNOLOGY CO. LTD, Sichuan (CN)

( * ) Notice: Subject to any disclaimer, the term of this patent is extended or adjusted under 35 U.S.C. 154(b) by 460 days.

(21) Appl. No.: 16/303,438

(22) PCT Filed: May 20, 2016

(86) PCT No.: PCT/CN2016/082730
§ 371 (c)(1),
(2) Date: Nov. 20, 2018

(87) PCT Pub. No.: WO2017/197633
PCT Pub. Date: Nov. 23, 2017

(65) Prior Publication Data
US 2019/0341727 A1 Nov. 7, 2019

(51) Int. Cl.
*H01R 13/713* (2006.01)
*H01R 43/26* (2006.01)

(52) U.S. Cl.
CPC ..... *H01R 13/713* (2013.01); *H01R 43/26* (2013.01)

(58) Field of Classification Search
CPC ..... H01R 13/713; H01R 43/26
(Continued)

(56) References Cited

U.S. PATENT DOCUMENTS 5,530,334 A * 6/1996 Ramspeck ..... H01M 50/50 361/600
6,530,793 B2 * 3/2003 Eichhorn ..... H01R 29/00 439/218
(Continued)

FOREIGN PATENT DOCUMENTS

CN 201608374 U 10/2010
CN 202034608 U 11/2011
(Continued)

*Primary Examiner* — Alfonso Perez Borroto
(74) *Attorney, Agent, or Firm* — Novick, Kim & Lee, PLLC; Allen Xue

(57) ABSTRACT

An intelligent power connecting device includes two connecting units to be connected and on-off units. The connecting units have conductor parts, insulation parts, and trigger units; the on-off units are electrically connected with the trigger units; delay units can be connected in series between the on-off units and the trigger units. A short circuit or electric leakage caused by instant electric conduction of the connector in a connecting process can be avoided. Intelligent control is achieved and the short circuit or electric leakage phenomenon caused by instant electric conduction is prevented during connection in the complex environment; electrified positions of the connector are fully isolated from the external environment and the connector is intelligently controlled; the insulation parts of the connector can achieve sealing isolation, the connected positions are effectively isolated from the complex external environment, and thus the two connecting units can be intelligently connected in the complex environment.

12 Claims, 9 Drawing Sheets

(58) Field of Classification Search
USPC ..... 307/112
See application file for complete search history.

(56) References Cited

U.S. PATENT DOCUMENTS

| | | | | |
|---|---|---|---|---|
| 2002/0097546 | A1* | 7/2002 | Weinberger | H02H 3/12 361/103 |
| 2004/0240141 | A1* | 12/2004 | Stolt | H01H 47/18 361/160 |

FOREIGN PATENT DOCUMENTS

| | | | | |
|---|---|---|---|---|
| CN | 102684040 | A | * | 9/2012 |
| CN | 102684040 | A | | 9/2012 |
| CN | 203826643 | U | * | 9/2014 |
| CN | 203826643 | U | | 9/2014 |
| CN | 105870736 | A | | 8/2016 |
| CN | 205646367 | U | | 10/2016 |
| KR | 20100011904 | A | | 2/2010 |

* cited by examiner

INTELLIGENT POWER CONNECTING METHOD AND INTELLIGENT CONNECTOR

FIELD OF THE INVENTION

The invention relates to an intelligent power connecting method and an intelligent connector that can be used for achieving intelligent power-on connection in a complex environment, relating to the field of electrical connection.

DESCRIPTION OF THE RELATED ART

There are countless safety incidents caused by electric leakage of appliance every year.

Among them, the leakages attributed to connection removal of appliance account for the majority. At present, the waterproof and leakage-proof connection technologies use the way of winding the insulation part and coating after the connection for closeness, which is cumbersome to use and must be in closed connection before entering the water. In coal mines, gas stations, filling stations and other flammable and explosive environments, the connection may produce spark and further result in an explosion and danger. On the other hand, the existing sockets lack waterproof effect, the sockets will automatically power on when water gets into the holes thereof, and therefore may cause electric shock when any person touches them. Therefore, sockets that can be safely used in humid and watery environments are not commercially available currently. More specifically, electric leakage may occur when conducting fluid, including water, oil and chemical reagents, enters the externally exposed holes on power sockets. In other words, the existing power sockets are not suitable for humid environments, such as kitchen and bathroom where water is easily in contact with the holes of the power sockets. What's more, the power sockets are also not suitable for outdoor environment where the sockets are easily affected with damp. Besides, by children or by accident, water may be splashed into the holes on power socket installed indoors. In such cases, power sockets with water in their holes are very dangerous and tend to trigger electric shock accident. The existing protection measure is to provide a waterproof box for the power socket. When the socket is not in use, the waterproof box covers up the holes on it to prevent water or other liquid from entry. This brings inconvenience to the users. Furthermore, if users forget to close the box or accidentally open the box to expose the holes, there is also a hidden danger that water enters the holes and causes an accident. That is to say, currently there is no completely reliable way to prevent the power sockets from triggering electric shock caused by water entering the holes.

The existing connectors have the following design deficiencies:

1. insufficient overall seal and closeness properties of connecting part;
2. troublesome utilization, difficult maintenance and even one-off connection; and
3. incapability to achieving safe electrified operation in a complex environment that is prone to electric leakage or short circuit, or possibility to cause electric leakage attributed to instant electric conduction in complex connecting environment.

SUMMARY OF THE INVENTION

The object of the invention is to provide an intelligent power connecting method and an intelligent connector to address the above problems. By this design, short circuit or electric leakage caused by instant electric conduction of the connector in a connecting process can be avoided; time is provided due to sealing of the connector, and the problem of insufficient overall seal and closeness properties of the connector in the connecting process is solved; use and maintenance difficulties are reduced; a safe electrified operation is achieved in a complex environment; intelligent control is achieved, and the short circuit or electric leakage phenomenon caused by instant electric conduction is prevented during connection in the complex environment.

The technical solution of the invention is as follows:

The invention discloses an intelligent power connecting method which comprises two connecting units to be connected and on-off units; the connecting units comprise conductor parts, insulation parts and trigger units; the on-off units are electrically connected with the trigger units; and delay units are capable of being connected in series between the on-off units and the trigger units, and electrical connection of the two connecting units comprises:

step 1: making the insulation parts of the two connecting parts in contact to isolate the conductor parts, the delay units and the trigger units from the external environment and trigger the trigger units; and step 2: triggering the on-off units to be on state by the trigger units, and making the conductor parts of the two connecting units on state by the on-off units; alternatively, triggering delay function of the delay units by the trigger units, controlling the on-off states to be on state after end of the delay of the delay units, and making the conductor parts of the two connecting units on state or triggering power-on logic relation by the on-off units.

In the steps, the trigger unit is triggered when the two connecting units are connected, thus controlling operation of the delay unit, ensuring that the two connecting units will not make the on-off unit on state during the connection process thereof, resulting in a leakage accident. By the delay action, the power-on time is postponed to guarantee that the insulation part can be completely sealed, with a view to preventing the on-off units from being on state due to incomplete sealing and avoiding electric leakage or short circuit. Compared with the existing technical waterproofing structure, the invention can prevent short circuit or electric leakage when the insulation is not completely isolated from the outside during the connector connection process. In addition, compared with the mechanical structure, the structure of this method, which can make the units on state by triggering at low voltage electricity, is simpler, more reliable and safer with shorter trigger distance and lower leakage probability. The design of the trigger unit ensures the trigger independence and adjustability, and enhances the reliability of on-off control. Moreover, the on-off units and the delay units can be externally installed to simplify the structural complexity of the connecting unit, miniaturize the connecting unit, facilitate independent production and replacement of the connecting unit and lower the production cost.

The trigger unit is a pressure controlled element, a magnetically controlled element or an optically controlled element, and the trigger unit outputs an electrical signal. The trigger unit triggers and outputs the electrical signal through pressure, magnetic field or light control to ensure multiple options and real-time selections according to different contexts, while enhancing the adaptability of the connector. The use of the electrical signal output can improve stability of the trigger unit and reduce production cost.

The delay unit is an MCU timer, an LC circuit or an RC circuit. The delay unit is designed such that the conductor part will not be conducted when the conductor part is not completely sealed during connection process of the connector. After the insulation part is connected, the conductor part will be on state to avoid the leakage or short circuit of the conductor part. The delay unit of the structure is simply structured, which can cut down the production cost and make the production easier.

At least two trigger units are electrically connected with each other in series or in series-parallel to trigger the delay units. The series trigger method avoids the leakage phenomenon caused by maloperation of the trigger and improves the safety and stability of the connector.

The connecting units comprise at least two parallel conductor parts, and the insulation parts of the two connecting units are in contact in a plug-in mode or a non-plug-in mode to form multiple insulation structures that are mutually isolated and matched with the conductor parts. The conductor parts arranged in parallel are universally used for existing connectors, such as plugs or sockets with more than two wires. The conductor parts are respectively provided with insulation structures to avoid short circuit between the conductor parts.

The on-off units control the conductor parts in one-to-one independent control mode or one-to-many uniform control mode. The control mode of the on-off unit can be regulated according to actual conditions and production costs.

The delay units control the on-off units in one-to-one independent control mode or one-to-many uniform control mode. The control mode of the delay unit can be regulated according to actual conditions and production costs.

The trigger units trigger the delay units in one-to-one independent trigger mode, one-to-many uniform trigger mode, many-to-one series trigger mode, many-to-one parallel trigger mode and many-to-one series-parallel trigger mode. The trigger mode of the trigger units can be regulated according to actual conditions.

An intelligent connector, characterized by comprising a contact part, an insulation part and a trigger unit; the contact part and the trigger unit being arranged in the insulation part; the trigger unit being configured to trigger a circuit logic connected with the trigger unit to electrify the contact part; and the insulation part being configured to isolate the charged contact part and the trigger unit from the external environment.

The intelligent connector has simple structure and a connection triggering conduction logic, is capable of achieving electrical conduction with an external device. And the connector is simply structured and independent of other devices, which can effectively avoid waste of production cost and simplify structure design to enhance the versatility of the connector in each environment. What's more, the intelligent connector has low cost, and the on-off unit and the trigger unit thereof are separated, which enhances the trigger independence. By series and parallel relationships between devices, multiple control of the on-off unit is realized to improve the on-off reliability and safety and reduce the probability of short circuit and electric leakage.

The trigger unit is electrically connected with an on-off unit, an input end of the on-off unit is electrically connected with a conductor part, an output end thereof is electrically connected to the contact part, and a delay unit is capable of being connected in series between the on-off unit and the trigger unit; and the trigger unit is configured to directly or indirectly trigger the on-off unit through the delay unit to control the on-off logic relationship between the conductor part and the contact part.

Thanks to the configuration, through the delay function of the delay unit, the leakage protection and short-circuit protection are realized when the intelligent connector is connected. At the same time, the trigger unit is safe and reliable and can be triggered in a safe manner to avoid leakage or short circuit accidents caused by premature or late trigger.

The insulation part comprises a front insulation part and a rear insulation part in sealing fit, a receiving cavity is arranged in the front insulation part or the rear insulation part, the receiving cavity is configured to receive the on-off unit and the delay unit, and the trigger unit is arranged at a connection end of the insulation part. The structure is designed to place the on-off unit and the delay unit in the middle of the connector, effectively isolating the on-off unit and the delay unit from the external complex environment, ensuring the normal use of the on-off unit and the delay unit, while simultaneously triggering the unit provided at the connecting end to achieve automatic trigger when the two connecting units are connected.

The on-off unit controls the conductor part to be charged in one-to-one independent control mode or one-to-many uniform control mode. The control mode of the on-off unit can be selected in real time as needed.

The delay unit controls the on-off unit in one-to-one independent control mode or one-to-many uniform control mode. The control mode of the delay unit can be selected in real time as needed.

The delay unit is an MCU timer, an LC circuit or an RC circuit. The delay unit can be selected according to demands. Various delay circuits have different advantages and disadvantages, and can be selected according to the needs of production and sale.

The trigger unit triggers the delay unit in one-to-one independent trigger mode, one-to-many uniform trigger mode, many-to-one series trigger mode, many-to-one parallel trigger mode and many-to-one series-parallel trigger mode. The trigger mode can be selected as needed.

At least two trigger units are electrically connected with each other in series or in series-parallel to trigger the delay units. The series connection of the multiple trigger units can improve reliability of the trigger units and reduce the probability of false trigger.

The trigger unit is a pressure controlled element, a magnetically controlled element or an optically controlled element, and the trigger unit outputs an electrical signal. The commercially available basic common electronic component can be used as the trigger unit to effectively reduce costs.

The intelligent connector is a connecting socket or connecting plug, the insulation parts of connecting socket and connecting plug are in contact in a plug-in mode or a non-plug-in mode to form multiple insulation structures that are mutually isolated and matched with the conductor parts. The parallel conductor parts are suitable for the connection modes of various commercially available connectors. The arrangement of the multiple insulation structures can effectively avoid occurrence of short circuit between the conductors.

The connecting socket comprises a first insulation part, a first conductor part, a first on-off unit, a first contact part, a first delay unit and a first trigger unit, the first contact part is electrically connected with the first conductor part through the first on-off unit, and the first trigger unit is electrically connected with the first on-off unit through the first delay unit; the connecting plug comprises a second conductor part and a second insulation part; and the connecting plug also comprises a second on-off unit, a second contact part, a second delay unit and a second trigger unit, the second contact part is electrically connected with the second conductor part through the second on-off unit, and the second trigger unit is electrically connected with the second on-off unit through the second delay unit. The first on-off unit is arranged between the first conductor part and the first contact part in this structure, ensuring insulation of the on-off unit. Meanwhile, the contact part can be configured as a combination of an elastic component and a contact to effectively ensure that the first contact part can be electrically connected with the connecting plug. Furthermore, the contact part is designed to effectively protect the on-off unit, the delay unit and the trigger unit and prolong the service life thereof. The connecting plug is of the mechanism similar to that of the connecting socket to further guarantee the conductor on-off, enhance the reliability of the connector and reduce the probability of short circuit and leakage between the conductors, so as to ensure that the connector can be completely sealed after connection of the connector.

The on-off units, the delay units or the trigger units can be separately removed. The detachable arrangement guarantees the service life of the connector, and the damaged units can be replaced in time.

The one-to-many uniform control mode uses a uniform signal as a control terminal to control the multiple parallel controlled terminals;

The one-to-one individual control mode uses an individual control signal as the control terminal to control the corresponding controlled terminal;

The many-to-one series control mode enables multiple control signals to be connected in series to control one corresponding controlled terminal;

The many-to-one parallel control mode enables multiple control signals to be connected in parallel to control one corresponding controlled terminal; and the many-to-one series-parallel control modes enables multiple control signals to be connected in series as a control group, and allows the multiple control groups to be connected in parallel to control one corresponding controlled terminal.

In summary, owing to the technical solution, the beneficial effects of the present invention are as follows:

1. The device can realize sufficient isolation and intelligent control of the connecting and electrified positions of the connector, and effectively prevent leakage or short circuit. The insulation part of the connector can realize sealed isolation and effectively isolate the connecting position from the external complex environment. Therefore, the design can realize intelligent connection of two connecting units in a complex environment. In addition, the delay unit of the design can prevent short circuit or leakage of the two connectors during the connection process.

By this design, short circuit or electric leakage caused by instant electric conduction of the connector in a connecting process can be avoided; time is provided due to sealing of the connector, and the problem of insufficient overall seal and closeness properties of the connector in the connecting process is solved; use and maintenance difficulties are reduced; a safe electrified operation is achieved in a complex environment; intelligent control is achieved and the short circuit or electric leakage phenomenon caused by instant electric conduction is prevented during connection in the complex environment.

Figure 1:
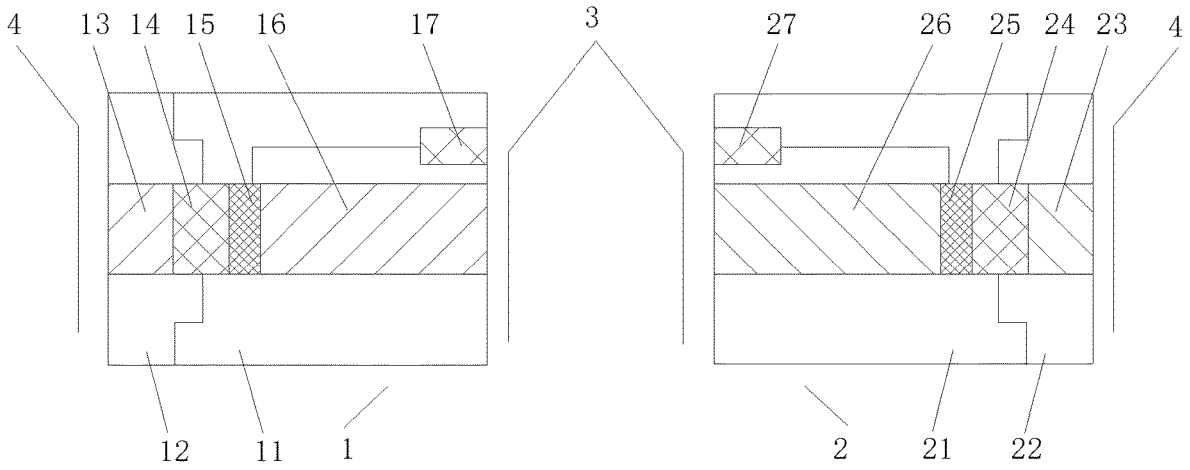
FIG. 1 is a structural diagram of the non-plug-in single-joint double control connection of the present invention.

Mark in the figures: 1—connecting socket, 11—front insulation part, 12—rear insulation part, 13—first conductor part, 14—first on-off unit, 15—first delay unit, 16—first contact part, 17—first trigger unit, 2—connecting plug, 21—front insulation part, 22—rear insulation part, 23—second conductor part, 24—second on-off unit, 25—second delay unit, 26—second contact part, 27—second trigger unit, 3—connecting end, 4—mounting end.

DESCRIPTION OF THE PREFERRED EMBODIMENTS

The invention will be described in detail in combination with drawings.

The invention will be further described in detail in combination with drawings and embodiments for clear understanding of the object, technical solution and advantages of the invention. It should be understood that various embodiments described herein are only used to explain the invention rather than limiting the invention.

Example 1

The invention discloses an intelligent power connecting method which comprises two connecting units to be connected and on-off units; the connecting units comprise conductor parts, insulation parts and trigger units; the on-off units are electrically connected with the trigger units; and delay units are capable of being connected in series between the on-off units and the trigger units, and electrical connection of the two connecting units comprises:

step 1: making the insulation parts of the two connecting parts in contact to isolate the conductor parts, the delay units and the trigger units from the external environment and trigger the trigger units; and step 2: triggering the on-off units to be on state by the trigger units, and making the conductor parts of the two connecting units on state by the on-off units; alternatively, triggering delay function of the delay units by the trigger units, controlling the on-off states to be on state after end of the delay of the delay units, and making the conductor parts of the two connecting units on state or triggering power-on logic relation by the on-off units.

The trigger unit is a pressure controlled element, a magnetically controlled element or an optically controlled element, and the trigger unit outputs an electrical signal. The delay unit is an MCU timer, an LC circuit or an RC circuit. At least two trigger units are electrically connected with each other in series or in series-parallel to trigger the delay units. The connecting units comprise at least two parallel conductor parts, and the insulation parts of the two connecting units are in contact in a plug-in mode or a non-plug-in mode to form multiple insulation structures that are mutually isolated and matched with the conductor parts. The on-off units control the conductor parts in one-to-one independent control mode or one-to-many uniform control mode. The delay units control the on-off units in one-to-one independent control mode or one-to-many uniform control mode. The trigger units trigger the delay units in one-to-one independent trigger mode, one-to-many uniform trigger mode, many-to-one series trigger mode, many-to-one parallel trigger mode and many-to-one series-parallel trigger mode.

Example 2

Figure 2:
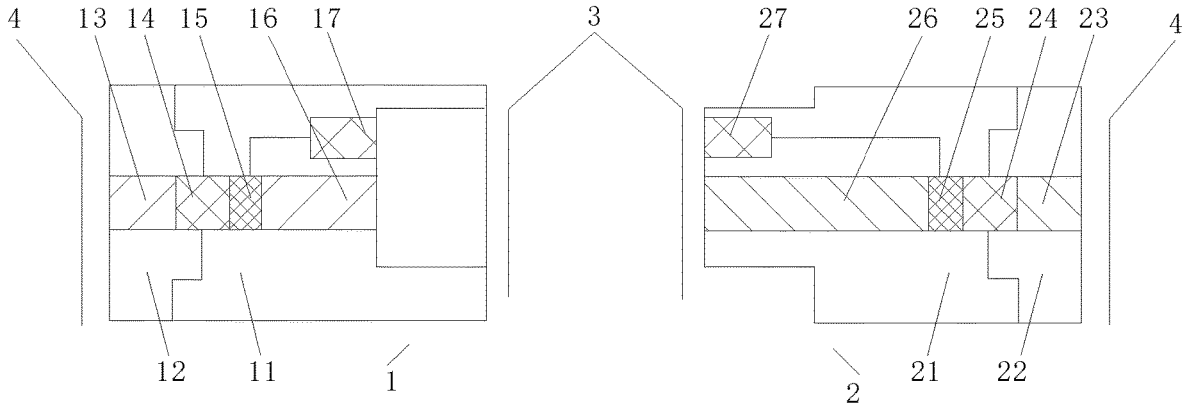
FIG. 2 is a structural diagram of the plug-in single-joint double control connection of the present invention.

As shown in FIG. 1 and FIG. 2, the invention discloses an intelligent connector which comprises two non-plug-in and plug-in connecting units to be connected, namely a connecting plug 2 and a connecting socket 1.

The connecting socket 1 comprises a first conductor part 13 and an insulation part, the insulation part comprises a front insulation part 11 and a rear insulation part 12; the front insulation part 11 and the rear insulation part 12 are in thread fit; the first conductor part 13 is arranged at the center of the rear insulation part 12, and a first contact part 16 can be arranged in the front insulation part 11; the front insulation part 11 and the rear insulation part 12 are combined to form a receiving cavity in which a first on-off unit 14 is arranged, and a first delay unit 15 can also be built into the receiving cavity; and the input end and output end of the first on-off unit 14 are electrically connected with the first conductor part 13 and the first contact part 16 respectively.

A control end of the first on-off unit 14 is electrically connected with the first delay unit 15; a first trigger unit 17 is arranged at a connecting end of the front insulation part 11, and the first trigger unit 17 is electrically connected with the first delay unit 15.

Alternatively, the control end of the first on-off unit 14 is electrically connected with the first trigger unit 17, and the first trigger unit directly triggers the on-off state of the on-off unit.

The connecting plug 2 comprises a second conductor part 23 and an insulation part, the insulation part comprises a front insulation part 21 and a rear insulation part 22 in mutual tight connection; the second conductor part 23 is arranged at the center of the rear insulation part 22, a second contact part 26 is arranged in the front insulation part 21, and a second on-off unit 24 and a second delay unit 25 are arranged between the front insulation part 21 and the rear insulation part 22; the input end and output end of the second on-off unit 24 are electrically connected with the second conductor part 23 and the second contact part 26 respectively, a control end of the second on-off unit 24 is electrically connected with the second delay unit 25; and a connecting end 3 of the front insulation part 21 is provided with a second trigger unit 27, and the second trigger unit 27 is electrically connected with the second delay unit 25.

When the connecting plug 2 is connected with the connecting socket 1, the insulation parts thereof are in mutual contact and isolate the conductor parts, the on-off units, the delay units and the trigger units from the complex external environment; the trigger units trigger the delay function of the delay units, the delay units control the on-off state of the on-off units, and the on-off units control the on-off state of the two conductor parts; alternatively, the trigger units trigger the on-off state of the on-off units, and the on-off units controls the on-off state of the two conductor parts. The on-off units, the delay units or the trigger units can be separately removed.

The connector can be electrically connected by the power connecting method of example 1.

Example 3

Figure 3:
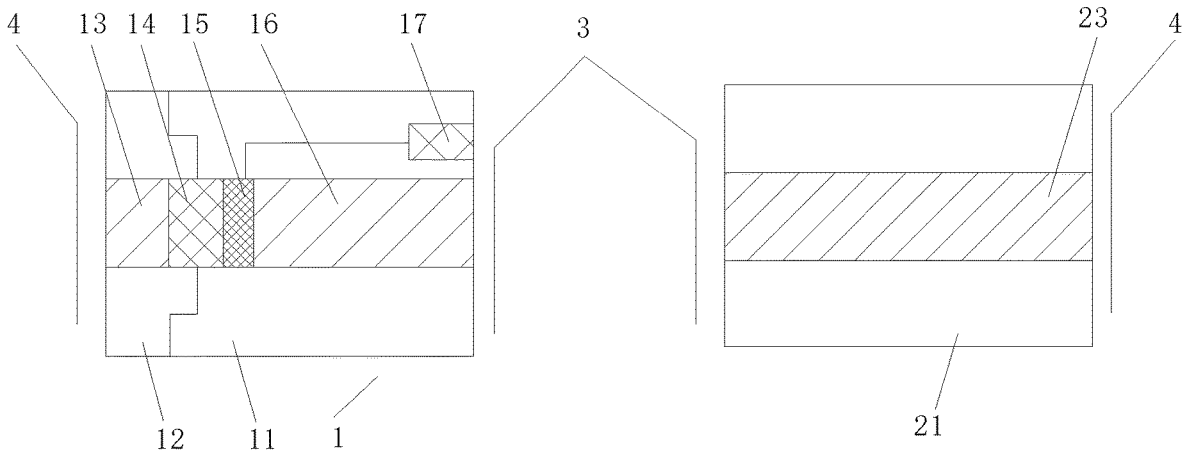
FIG. 3 is a structural diagram of the non-plug-in single-joint single control connection of the present invention.
Figure 4:
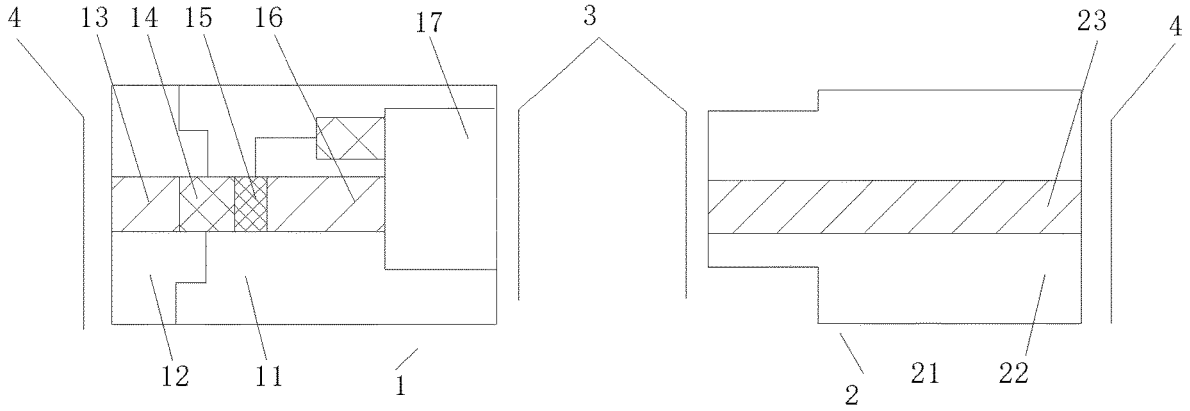
FIG. 4 is a structural diagram of the plug-in single-joint single-control connection of the present invention.

As shown in FIG. 3 and FIG. 4, the invention discloses an intelligent connector which comprises two plug-in and non-plug-in connecting units to be connected, namely a connecting plug 2 and a connecting socket 1.

The connecting socket 1 can be of the structure of the connecting socket 1 in the example 2. The connecting plug 2 comprises a second conductor part 23 and a rear insulation part 21, and the rear insulation part 21 is wrapped in the external layer of the second conductor part 23; and the connector can be connected by the power connecting method of the example 1.

Example 4

Figure 5:
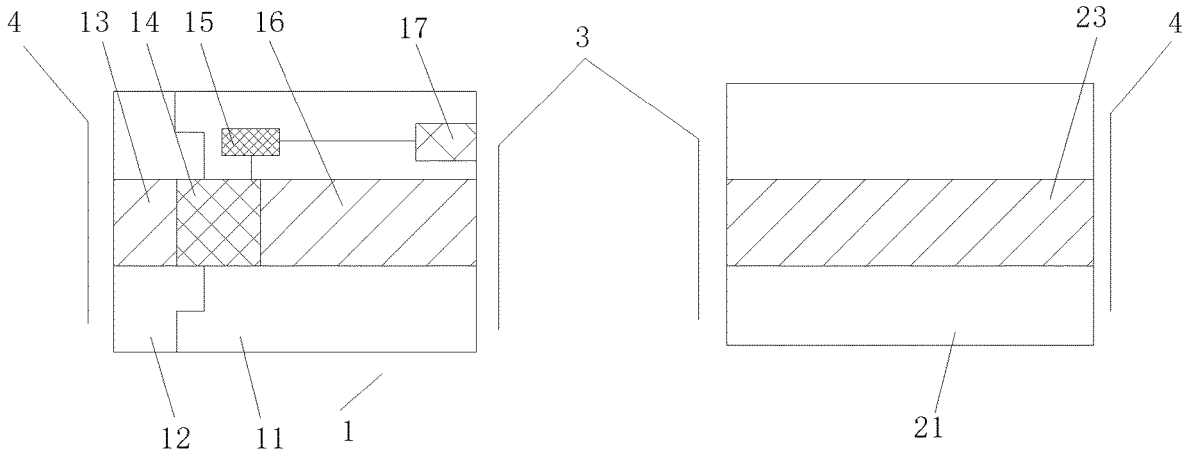
FIG. 5 is a structural diagram of the non-plug-in single-joint single control connection (independent delay unit) of the present invention.

As shown in FIG. 5, the invention discloses an intelligent connector which comprises two non-plug-in connecting units to be connected, namely a connecting plug 2 and a connecting socket 1.

The connecting socket 1 comprises a first conductor part 13 and an insulation part, the insulation part comprises a front insulation part 11 and a rear insulation part 12, the front insulation part 11 and the rear insulation part 12 are in sealing fit; the conductor part is arranged at the center of the rear insulation part 12, and a first contact part 16 is arranged in the front insulation part 11; the front insulation part 11 and the rear insulation part 12 are combined to form a receiving cavity in which a first on-off unit 14 is arranged; a first delay unit 15 is arranged in the front insulation part; the input end and output end of the first on-off unit 14 are electrically connected with the conductor part and the first contact part 16 respectively, and a control end of the first on-off unit 14 is electrically connected with the first delay unit 15; and a connecting end 3 of the front insulation part 11 is provided with a first trigger unit 17, and the first trigger unit 17 is electrically connected with the first delay unit 15.

The connecting plug 2 can be of the structure of the connecting plug 2 in the example 3. The connector can be connected by the power connecting method of the example 1.

Example 5

Figure 6:
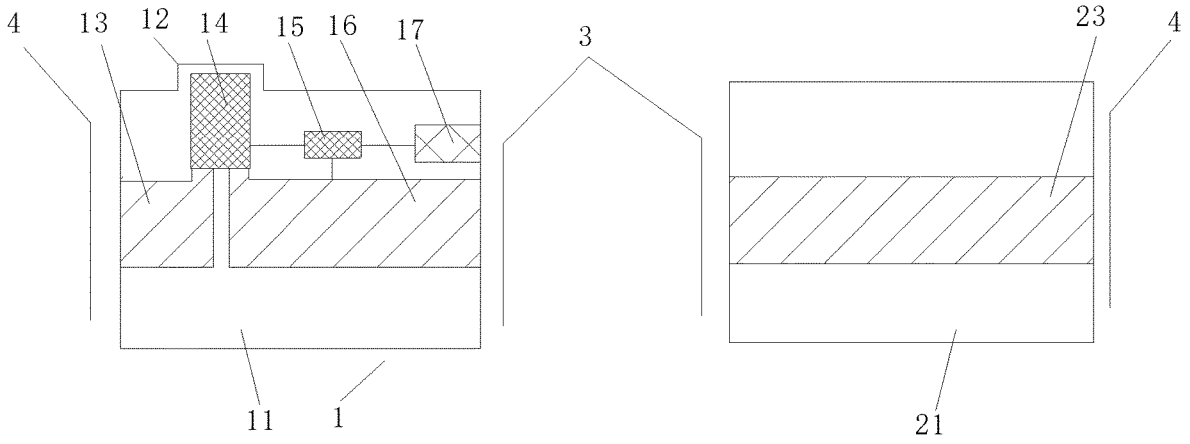
FIG. 6 is a structural diagram of the non-plug-in single-joint single control connection (lateral on-off unit) of the present invention.
Figure 7:
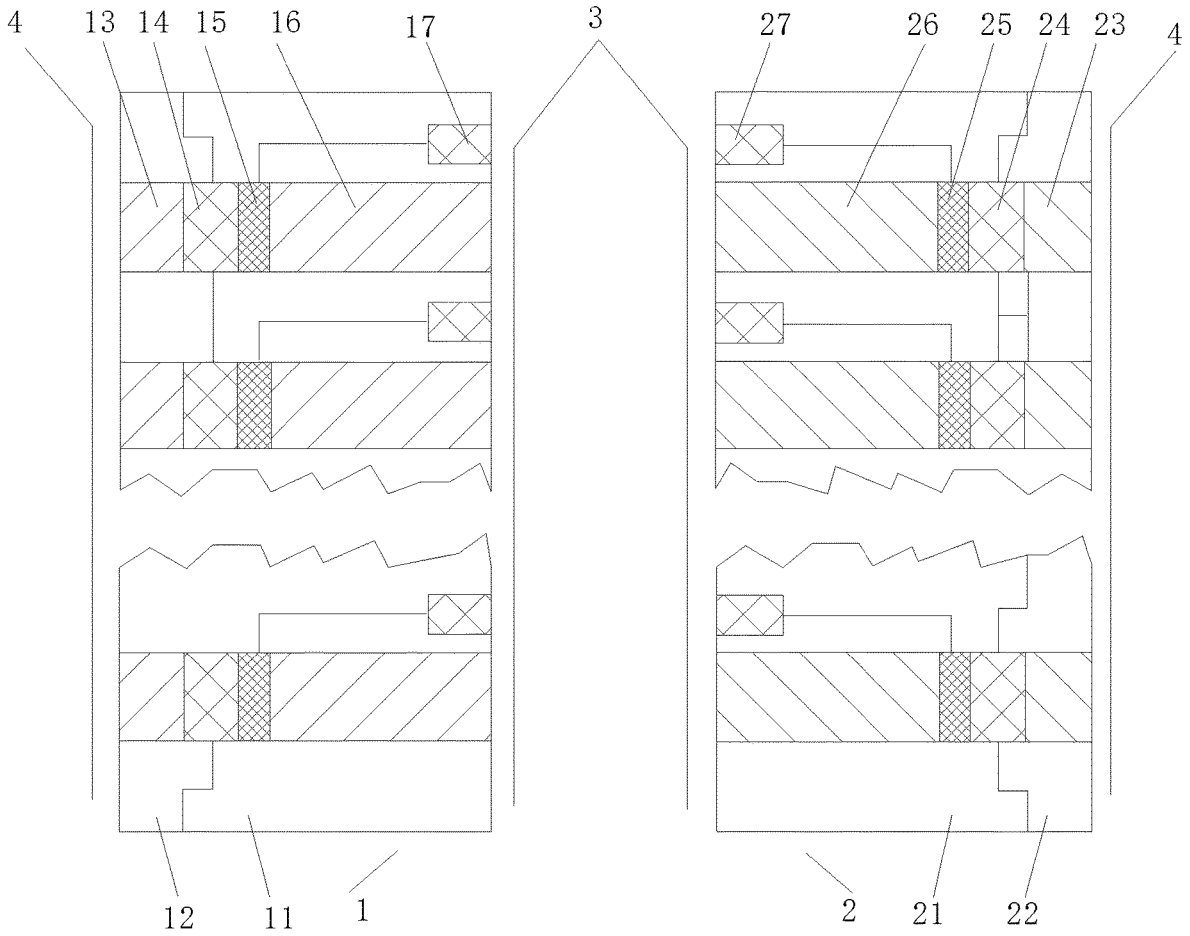
FIG. 7 is a structural diagram of the non-plug-in single-joint single control connection (lateral on-off unit)

As shown in FIG. 6, the invention discloses an intelligent connector which comprises two non-plug-in connecting units to be connected, namely a connecting plug 2 and a connecting socket 1.

The connecting socket 1 comprises a first conductor part 13 and an insulation part, the insulation part comprises a front insulation part 11 and a rear insulation part 12, and the front insulation part 11 and the rear insulation part 12 are in sealing fit; the first conductor part 13 and a first contact part 16 are arranged on the rear side and front side of the front insulation part 11 respective; the front insulation part is provided with a receiving cavity in which a first on-off unit 14 is arranged, equivalent to the arrangement that the first on-off unit is arranged on the connecting socket in an external way; the rear insulation part 12 covers on the front insulation part 11 as a sealing cover of the receiving cavity, and a first delay unit 15 is arranged in the front insulation part 11; the input end and output end of the first on-off unit 14 are electrically connected with the conductor part and the first contact part 16 respectively, and a control end of the first on-off unit 14 is electrically connected with the first delay unit 15; and a connecting end 3 of the front insulation part 11 is provided with a first trigger unit 17, and the first trigger unit is electrically connected with the first delay unit 15.

The connecting plug 2 can be of the structure of the connecting plug 2 in the example 3. The connector can be connected by the power connecting method of the example 1.

Example 6

Figure 8:
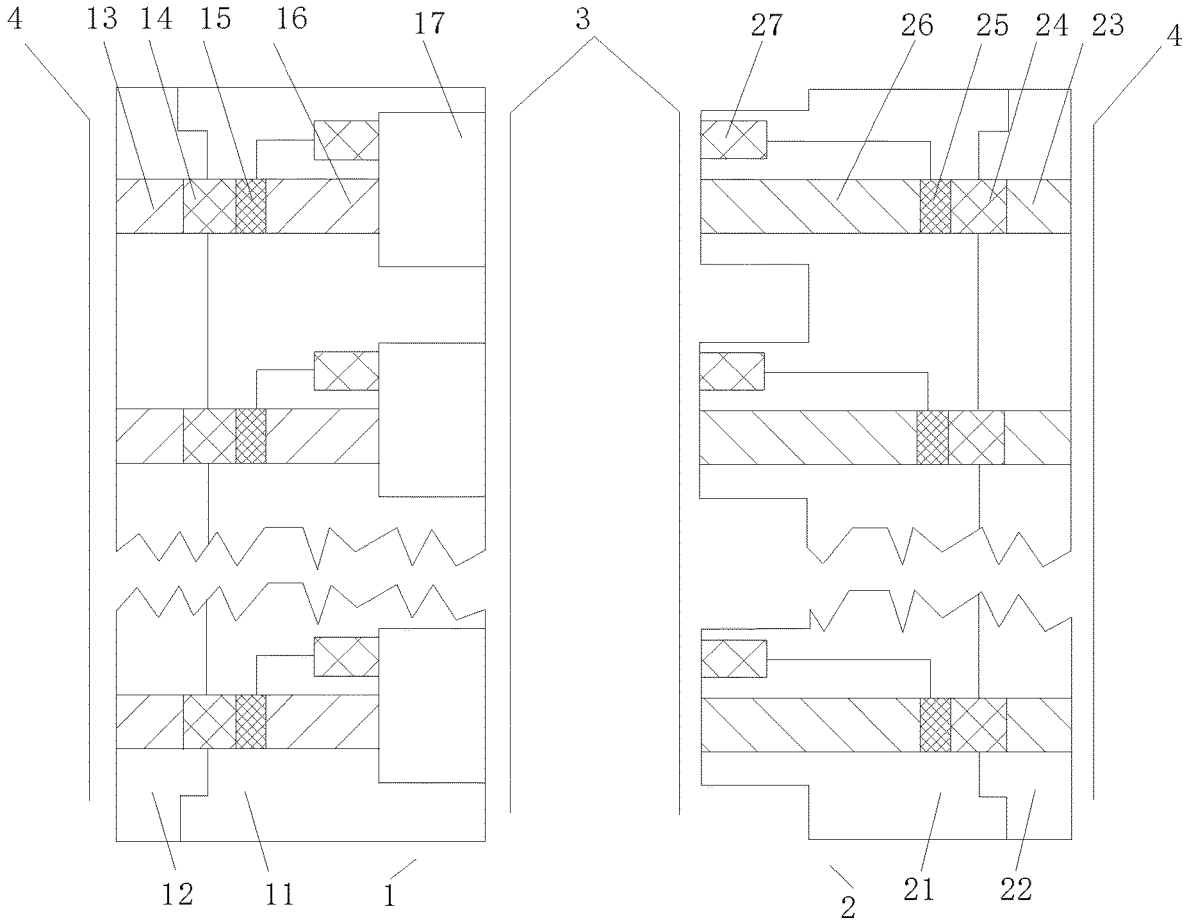
FIG. 8 is a structural diagram of the plug-in multi joint double control multi-delay connection.

As shown in FIG. 1 and FIG. 8, the invention discloses an intelligent connector which comprises two plug-in and non-plug-in connecting units to be connected, namely a connecting plug 2 and a connecting socket 1.

The connecting socket 1 comprises multiple parallel first conductor parts 13 and an insulation part, the insulation part comprises a front insulation part 11 and a rear insulation part 12, and the front insulation part 11 and the rear insulation part 12 are in sealing fit; the parallel first conductor parts 13 are arranged in the rear insulation part 12, and multiple first contact parts 16 respectively corresponding to the first conductor parts 13 are arranged in the front insulation part 11; the front insulation part 11 and the rear insulation part 12 are combined to form multiple receiving cavities, and each of the receiving cavities is provided with a first on-off unit 14 and a first delay unit 15 respectively, the input end and output end of the first on-off unit 14 are electrically connected with the corresponding first conductor part 13 and the corresponding first contact part 16 respectively, and a control end of the first on-off unit 14 is electrically connected with the corresponding first delay unit 15; and a connecting end 3 of the front insulation part 11 is provided with a corresponding first trigger unit 17, and the first trigger unit is electrically connected with the first delay unit 15.

The connecting plug 2 comprises multiple parallel second conductor parts 23 and an insulation part, the insulation part comprises a front insulation part 21 and a rear insulation part 22 in mutual tight connection, and the parallel second conductor parts 23 are arranged in the rear insulation part 22, second contact parts 26 respectively corresponding to the first conductor parts are arranged in the front insulation part 21, and multiple second on-off units 24 and second delay units 25 are arranged between the front insulation part 21 and the rear insulation part 22; the input end and output end of the second on-off unit 24 are electrically connected with the corresponding second conductor part 23 and the corresponding second contact part 26 respectively, and a control end of the second on-off unit 24 is electrically connected with the corresponding second delay unit 25; and a connecting end 3 of the front insulation part 21 is provided with a corresponding second trigger unit 27, and the second trigger unit is electrically connected with the second delay unit 25.

When the connecting plug 2 is connected with the connecting socket 1, the insulation parts thereof are in mutual contact and isolate the conductor part, the on-off unit, the delay unit and the trigger unit from the complex external environment to form multiple mutually isolated insulation structures. The first contact part 16 and the corresponding second contact part 26 achieve electrical connection in the corresponding insulation structure; and the trigger unit triggers the delay function of the delay unit, the delay unit controls on-off state of the on-off unit, and the on-off unit controls on-off state of the two conductor parts. The on-off units, the delay units or the trigger units can be separately removed.

The connector can be electrically connected by the power connecting method of the example 1. The on-off unit of the connector controls the conductor part in one-to-one independent control mode, the delay unit thereof controls the on-off unit in one-to-one independent control mode, and the trigger unit thereof triggers the delay unit in one-to-one independent trigger mode.

Example 7

Figure 9:
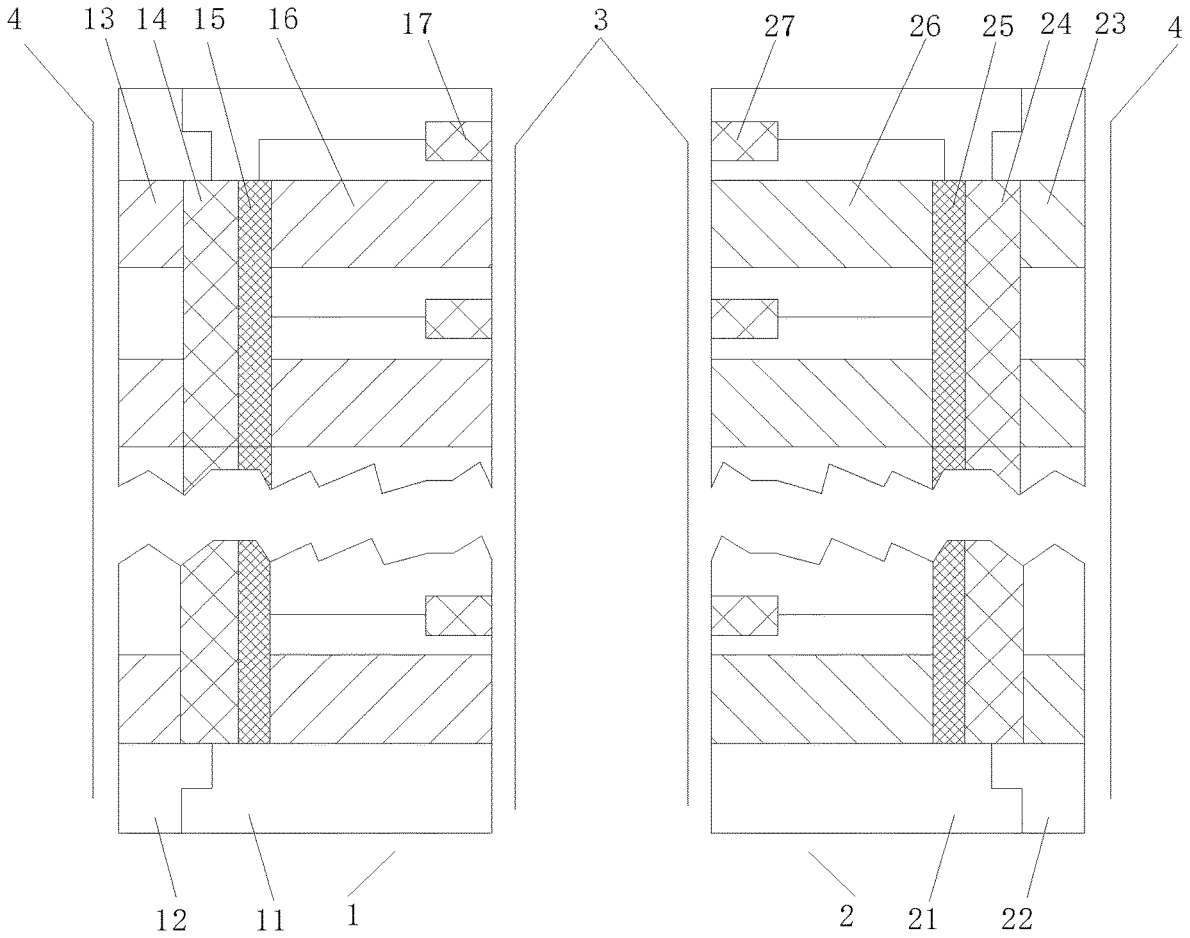
FIG. 9 is a structural diagram of the non-plug-in multi joint double control single-delay connection.
Figure 10:
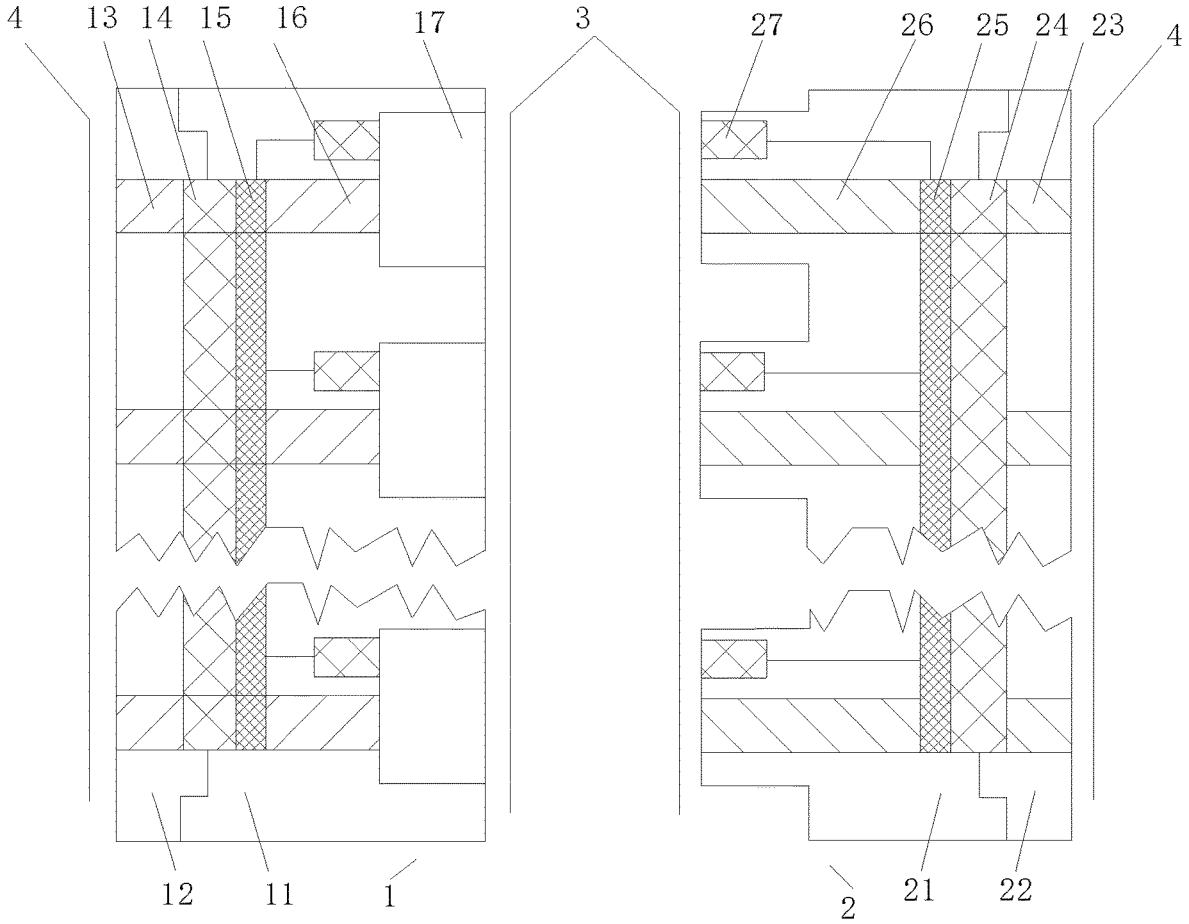
FIG. 10 is a structural diagram of the plug-in multi joint double control single-delay connection.

As shown in FIG. 9 and FIG. 10, the invention discloses an intelligent connector which comprises two plug-in and non-plug-in connecting units to be connected, namely a connecting plug 2 and a connecting socket 1.

The connecting socket 1 comprises multiple parallel first conductor parts 13 and an insulation part, the insulation part comprises a front insulation part 11 and a rear insulation part 12, and the front insulation part 11 and the rear insulation part 12 are in sealing fit; the parallel first conductor parts 13 are arranged in the rear insulation part 12, multiple first contact parts 16 respectively corresponding to the first conductor parts 13 are arranged in the front insulation part 11, and the front insulation part 11 and the rear insulation part 12 are combined to form an integral receiving cavity in which a first on-off unit 14 and a first delay unit 15 are arranged, the first on-off unit 14 comprises multiple on-off modules, and the input ends and output ends of the on-off modules are electrically connected with the corresponding first conductor parts 13 and the corresponding first contact parts 16 respectively, the control end of the first on-off unit 14 is electrically connected with the corresponding first delay unit 15; a connecting end 3 of the front insulation part 11 is provided with multiple parallel first trigger units 17, and the first trigger units 17 are electrically connected with the first delay units 15. The connecting plug 2 comprises multiple parallel second conductor parts 23, an insulation part, a second on-off unit 24, a second delay unit 25, multiple second trigger units 27 and multiple second contact parts 26, and the electrical connection relationship of the components of the connecting plug 2 are the same as that of the corresponding components of the connecting socket 1.

When the connecting plug 2 is connected with the connecting socket 1, the insulation parts thereof are in mutual contact and isolate the conductor part, the on-off unit, the delay unit and the trigger unit from the complex external environment to form multiple mutually isolated insulation structures. The first contact part 16 and the corresponding second contact part 26 achieve electrical connection in the corresponding insulation structure; and the trigger unit triggers the delay function of the delay unit, the delay unit controls on-off state of the on-off unit, and the on-off unit controls on-off state of the two conductor parts. The on-off units, the delay units or the trigger units can be separately removed.

The connector can be electrically connected by the power connecting method of the example 1. The on-off unit of the connector controls the conductor part in one-to-one independent control mode, the delay unit thereof controls the on-off units in one-to-many control mode, and the trigger units thereof trigger the delay unit in parallel many-to-one trigger mode.

实施例 8

Figure 11:
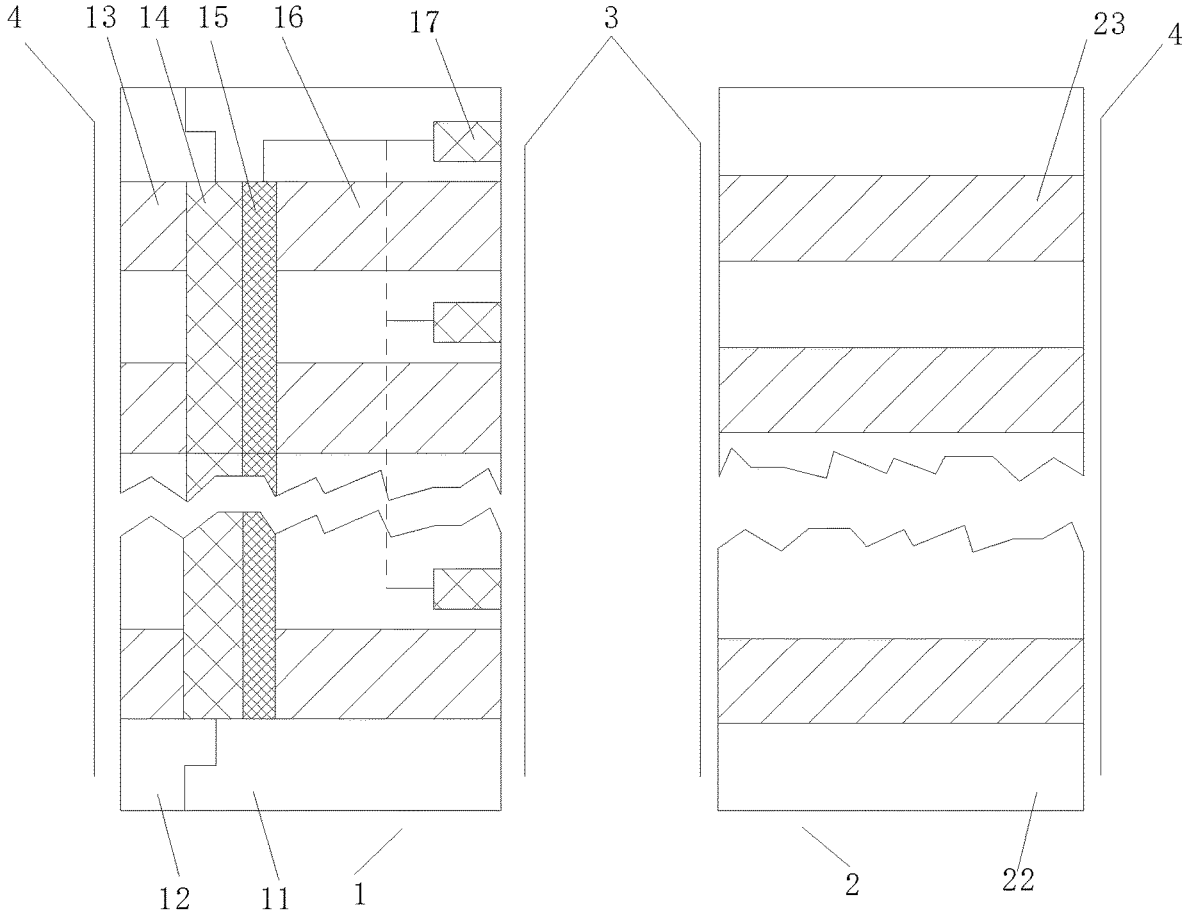
FIG. 11 is a structural diagram of the non-plug-in multi joint single control single-delay connection.
Figure 12:
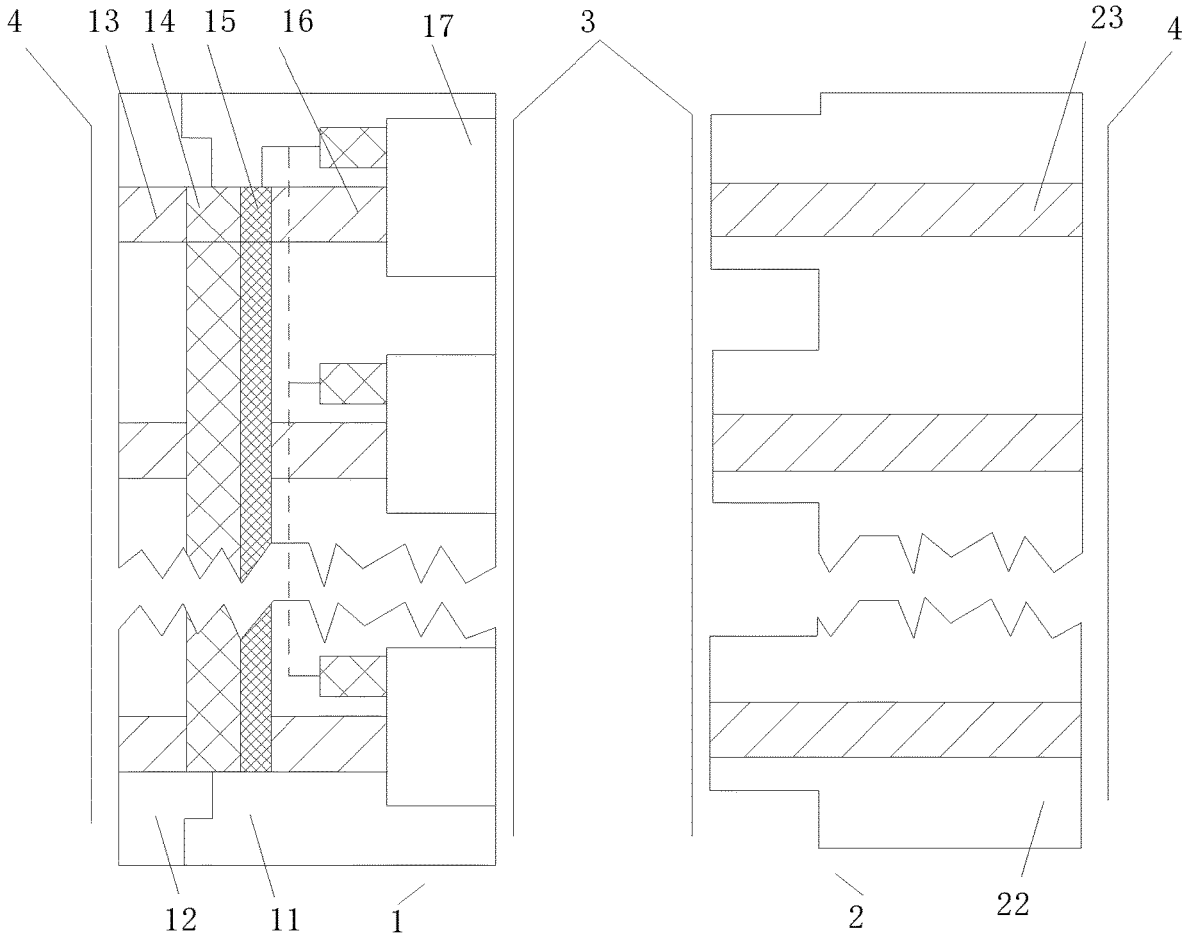
FIG. 12 is a structural diagram of the plug-in multi joint single control single-delay connection.

As shown in FIG. 11 and FIG. 12, the invention discloses an intelligent connector which comprises two plug-in or non-plug-in connecting units to be connected, namely a connecting plug 2 and a connecting socket 1.

The connecting socket 1 comprises multiple parallel first conductor parts 13 and an insulation part, the insulation part comprises a front insulation part 11 and a rear insulation part 12, and the front insulation part 11 and the rear insulation part 12 are in sealing fit; the parallel first conductor parts 13 are arranged in the rear insulation part 12, multiple first contact parts 16 respectively corresponding to the first conductor parts 13 are arranged in the front insulation part 11, and the front insulation part 11 and the rear insulation part 12 are combined to form an integral receiving cavity in which a first on-off unit 14 and a first delay unit 15 are arranged, the first on-off unit 14 comprises multiple on-off modules, and the input ends and output ends of the on-off modules are electrically connected with the corresponding first conductor parts 13 and the corresponding first contact parts 16 respectively, the control end of the first on-off unit 14 is electrically connected with the corresponding first delay unit 15; a connecting end 3 of the front insulation part 11 is provided with multiple parallel first trigger units 17, and the first trigger units 17 are electrically connected with the first delay units 15.

The connecting plug 2 comprises multiple parallel second conductor parts 23 and an insulation part, and the insulation part wraps multiple second conductor parts 23 and is configured to fix and isolate the multiple second conductor parts 23.

The connector can be electrically connected by the power connecting method of the example 1. The on-off units of the connector control on-state between the conductor parts in one-to-one independent control mode or many-to-one control mode, the delay unit controls the on-off unit in one-to-many control mode, and the trigger units trigger the delay unit in many-to-one series and parallel trigger mode.

Example 9

Built on the connectors of examples 2-9 or based on the power connecting method of example 1, the series and parallel power connection of the on-off unit, the delay unit and the trigger unit enables:

one-to-one independent control or one-to-many uniform control of the conductor parts by the on-off unit;

one-to-one independent control or one-to-many uniform control of the on-off units by the delay unit; and one-to-one independent trigger, one-to-many uniform trigger, many-to-one series trigger, many-to-one parallel trigger or many-to-one series-parallel trigger of the delay units by the trigger units.

The delay unit can be an MCU timer, an LC circuit or an RC circuit.

In the structure, at least two trigger units are electrically connected with each other in series or in series-parallel to trigger the delay units.

The above trigger unit is a voltage-controlled element, a magnetically controlled element or an optically controlled element, and the output signal of the trigger unit is electrical signal.

The connecting units comprise at least two parallel conductor parts, and the insulation parts of the two connecting units are in contact in a plug-in mode or a non-plug-in mode to form multiple insulation structures that are mutually isolated and matched with the conductor parts.

The above examples are only preferred examples of the invention and not used to limit the invention. Any modification, equivalent replacement and improvement made within the spirit and rule of the invention shall be incorporated in the protection scope of the invention.

The invention claimed is:

1. An intelligent connector, comprises a trigger, a contact part, and a circuit logic disposed in an insulation part, wherein the circuit logic comprises a delay unit and an on-off unit, and the delay unit and the on-off unit are electrically connected in series, wherein the contact part is electrically connected to the circuit logic through the on-off unit, wherein the trigger unit is connected to the delay unit so as to control the delay unit, and the delay unit controls an on-off state of the on-off unit to electrify the contact part, wherein the trigger unit, the on-off unit, and the delay unit are serviceably detachable from one another, and wherein the insulation part insolates the contact part and the trigger unit from the environment outside of the connector.

2. The intelligent connector of claim 1, wherein the trigger unit is electrically connected with the on-off unit, an input end of the on-off unit is electrically connected with a conductor part, an output end of the on-off unit is electrically connected to the contact part, and a delay unit is connected in series between the on-off unit and the trigger unit; and the trigger unit is configured to directly or indirectly trigger the on-off unit through the delay unit to control the power on-off logic relationship between the conductor part and the contact part.

3. The intelligent connector of claim 1, wherein the insulation part comprises a front insulation part and a rear insulation part in sealing fit, a receiving cavity is arranged in the front insulation part or the rear insulation part, the receiving cavity is configured to receive the on-off unit and the delay unit, and the trigger unit is arranged at a connecting end of the insulation part.

4. The intelligent connector of claim 1, wherein the on-off unit controls the conductor part to be charged in one-to-one independent control mode or one-to-many uniform control mode.

5. The intelligent connector of claim 1, wherein the delay unit controls the on-off unit in one-to-one independent control mode or one-to-many uniform control mode.

6. The intelligent connector of claim 5, wherein the delay unit is an MCU timer, an LC circuit or an RC circuit.

7. The intelligent connector of claim 1, wherein the trigger unit triggers the delay unit in one-to-one independent trigger mode, one-to-many uniform trigger mode, many-to-one series trigger mode, many-to-one parallel trigger mode or many-to-one series-parallel trigger mode.

8. The intelligent connector of claim 7, wherein at least two trigger units are electrically connected with each other in series or in series-parallel to trigger the delay unit.

9. The intelligent connector of claim 7, wherein the trigger unit is a pressure controlled element, a magnetically controlled element or an optically controlled element, and the trigger unit outputs an electrical signal.

10. The intelligent connector of claim 1, wherein the intelligent connector is a connecting socket or a connecting plug, the insulation part of the connecting socket and the insulation part of the connecting plug are in contact in a plug-in mode or a non-plug-in mode to form multiple insulation structures that are mutually isolated and matched with the conductor parts.

11. The intelligent connector of claim 10, wherein the connecting socket comprises a first insulation part, a first conductor part, a first on-off unit, a first contact part, a first delay unit and a first trigger unit, and during operations, the first contact part is electrically connected with the first conductor part through the first on-off unit, and the first trigger unit is electrically connected with the first on-off unit through the first delay unit;

wherein the connecting plug comprises a second conductor part, a second insulation part, a second on-off unit, a second contact part, a second delay unit and a second trigger unit, and, during operations, the second contact part is electrically connected with the second conductor part through the second on-off unit, and the second trigger unit is electrically connected with the second on-off unit through the second delay unit.

12. An intelligent connector, comprises at least two triggers, at least two contact parts, and at least two circuit logics disposed in an insulation part, wherein each of the at least two circuit logics comprises a delay unit and an on-off unit, and the delay unit and the on-off unit are electrically connected, wherein each of the at least two contact parts is electrically connected to one of the at least two circuit logics through the on-off unit that is comprised within the circuit logic, wherein each of the at least two trigger units is electrically connected to one of the at least two delay units to control an on-off state of one of the at least two on-off units, and to electrify one of the at least two contact parts, wherein each of the at least two trigger units, the at least two on-off units, and the at least two delay units are serviceably detachable from one another, and wherein the insulation part insolates the at least two contact parts and the at least two trigger units from the environment outside of the connector.

* * * * *